US008257645B2

(12) United States Patent
Lee et al.

(10) Patent No.: US 8,257,645 B2
(45) Date of Patent: Sep. 4, 2012

(54) INSULATION BRICK

(75) Inventors: Yong Lee, Munster, IN (US); Jamey Costino, Munster, IN (US); Jim Norris, Highland, IN (US); Bernard Chukwulebe, Lansing, IL (US)

(73) Assignee: Arcelormittal Investigacion y Desarrollo, S.L., Sestao (ES)

( * ) Notice: Subject to any disclaimer, the term of this patent is extended or adjusted under 35 U.S.C. 154(b) by 220 days.

(21) Appl. No.: 12/758,093

(22) Filed: Apr. 12, 2010

(65) Prior Publication Data

US 2011/0247535 A1 Oct. 13, 2011

(51) Int. Cl.
*F23M 5/02* (2006.01)

(52) U.S. Cl. ..... 266/283; 266/286; 266/280

(58) Field of Classification Search ..... 266/283, 266/280, 286; D25/151
See application file for complete search history.

(56) References Cited

U.S. PATENT DOCUMENTS

| | | | | |
|---|---|---|---|---|
| 1,647,083 | A | 10/1927 | Croll | |
| 1,751,008 | A | 3/1930 | La France | |
| 2,010,055 | A | 8/1935 | Brown | |
| 2,042,870 | A | 6/1936 | Stafford | |
| 2,727,737 | A | 12/1955 | Dole | |
| 2,836,412 | A | 5/1958 | Krieger | |
| 3,269,070 | A | 8/1966 | Stoy | |
| 3,800,014 | A | 3/1974 | Brichard | |
| 4,149,705 | A | 4/1979 | Caudill | |
| 4,705,475 | A | 11/1987 | Coates | |
| 4,860,505 | A | 8/1989 | Bender | |
| 5,139,239 | A | 8/1992 | Eccleston | |
| 5,824,263 | A * | 10/1998 | Erny et al. | 266/283 |
| 2007/0277471 | A1 | 12/2007 | Gibson | |
| 2009/0020927 | A1 | 1/2009 | Barrett et al. | |

* cited by examiner

*Primary Examiner* — Scott Kastler
(74) *Attorney, Agent, or Firm* — Berenato & White, LLC

(57) ABSTRACT

Presented are an insulation brick and the method of using an insulation brick to create a thermal lining. A set of corrugations are formed into a sidewall of the brick to increase the thermal insulation. A first end of the insulation brick has a convex portion while the second end of the insulation brick has a convex portion. This allows a first insulation brick to mate with another brick in an end to end configuration.

13 Claims, 5 Drawing Sheets

INSULATION BRICK

BACKGROUND

Vessels for holding high temperature materials, such as molten metal, are typically lined with a material to provide thermal insulation. Proper thermal insulation helps prevent thermal loss, saving energy and reducing the cost associated with preheating vessels. Thermal insulation also helps reduce the wear and tear on the vessel.

Vessels used to transport molten metals often undergo creep deformation caused by long exposure to high temperatures. Because creep increases with temperature, the less efficient the thermal insulation is, the greater the rate of creep will be. This can be a serious problem as the vessel may eventually deform to the point where it can no longer be used for its intended purpose and, in certain cases, deformation of the vessel may result in failure during use, posing a serious safety hazard.

An example of a vessel used to transport high temperature materials is a ladle used in the steelmaking process to transport molten metal from a blast furnace. Because of the high temperature associated with molten metal, the ladle undergoes extreme temperature swings. Over a period of time this results in creep deformation of the ladle's steel shell. The deformation has increased in modern steelmaking since carbon-containing refractory bricks were developed for use as linings in the early 1980s. The molten metal as well as the deformation of the ladle shell deteriorates the ladle brick lining and often leads to cracking and possibly catastrophic failures of both the lining and the shell. Lining a ladle with typical insulation brick can also be a time consuming and expensive task.

Numerous methods and devices have been developed in an attempt to improve the thermal efficiency of holding vessels. One of these methods utilizes a lining made from ceramic insulation board. This method, however, also suffers from drawbacks. Because ceramic insulation boards are typically highly porous, they have a tendency to shrink or abrade during use. This can lead to a loss of compression in the working linings, creating a gap between the bricks, and allow molten metal to penetrate the lining. This greatly reduces the thermal efficiency and can damage the vessel. Additionally, linings have been made by spraying refractory material over consumable insulation boards. The sprayed linings, however, are quickly degraded and must be replenished frequently. This can result in added expensive and a loss of productivity as the vessel is taken out of service to be relined.

SUMMARY

In an exemplary embodiment, the present invention is directed to an insulation brick. The insulation brick has an upper surface, a lower surface, a first end, a second end, an inner sidewall and an outer sidewall. The first end of the insulation brick has a convex portion while the second end of the insulation brick has a complementarily shaped concave portion. The outer sidewall of the insulation brick has a set of corrugations.

In an exemplary embodiment, the present invention is directed to a vessel for holding a high temperature material, preferably a molten metal. The vessel is a steel ladle having a shell with an outer wall and an inner wall. The steel ladle is lined with a first layer of insulation bricks having an upper surface, a lower surface, a first end, a second end, an inner sidewall, and an outer sidewall. The outer sidewall has a set of corrugations. A second layer of insulation bricks having an upper surface, a lower surface, a first end, a second end, an inner sidewall, and an outer sidewall having a set of corrugations is placed on top of the first layer of insulation bricks. The outer sidewall of the insulation bricks are adjacent the inner wall of the steel ladle.

DETAILED DESCRIPTION OF EXEMPLARY EMBODIMENT(S) AND EXEMPLARY METHOD(S)

Figure 1:
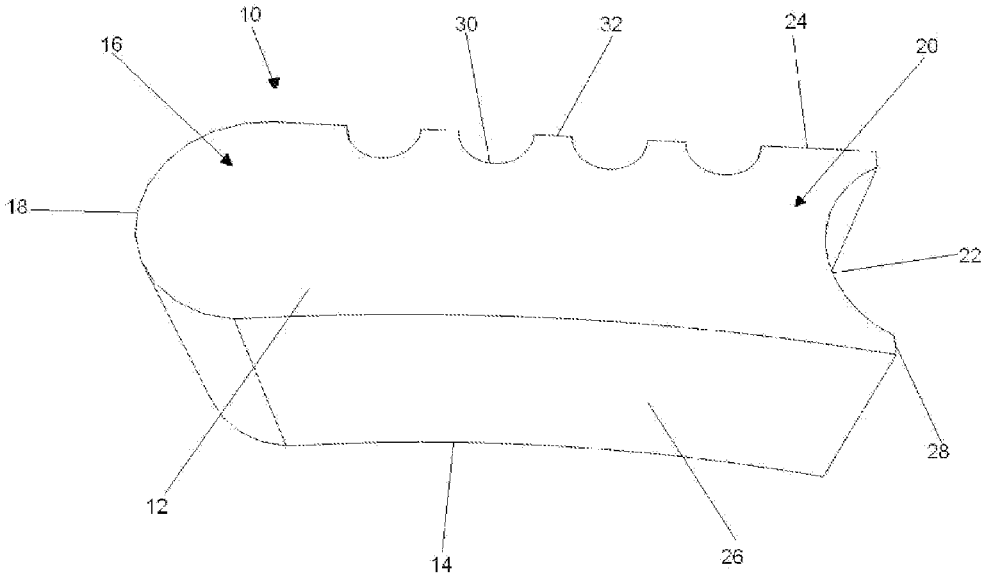
FIG. 1 is a perspective view of an exemplary insulation brick.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

Figure 2:
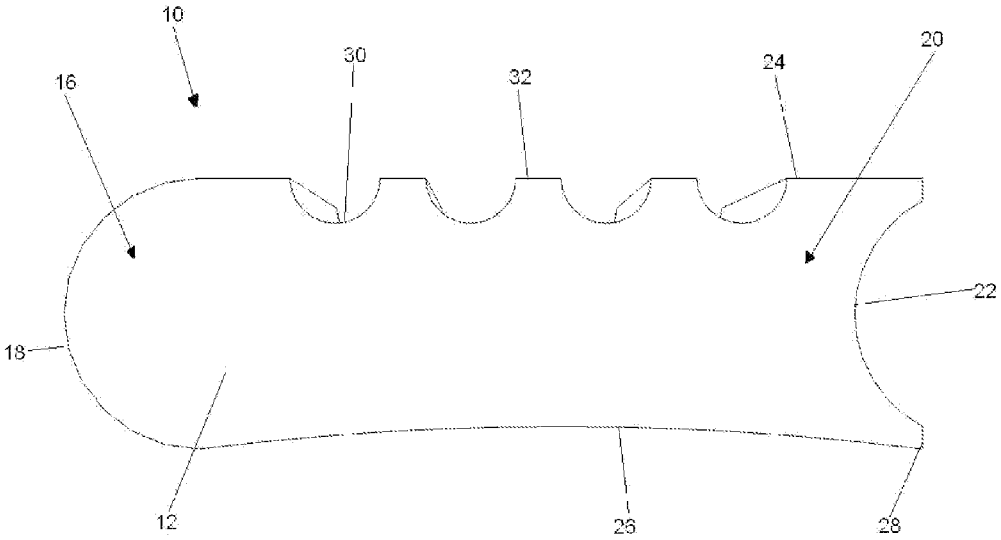
FIG. 2 is a plane view of an exemplary insulation brick.

Best shown in FIGS. 1 and 2 is an exemplary embodiment of an insulation brick 10. The insulation brick 10 has a top surface 12 and a bottom surface 14. The top and bottom surfaces 12, 14 may be planar or non-planar depending upon the vessel they are to be used with. The brick 10 has a first end 16 having a convex portion 18 and also a second end 20 having a concave portion 22, which is complementarily shaped to match the convex portion 18. The brick 10 has an outer sidewall 24 and an inner sidewall 26. In an exemplary embodiment, the first end 16 will transition directly from the convex portion 18 into the sidewalls 24, 26, while the second end 20 may have flat portions 28 connecting the sidewalls 24, 26 to the concave portion 22. Depending upon the vessel to be lined, the outer and inner sidewalls 24, 26 of the insulation brick 10 may have a radius of curvature. When dealing with a curved vessel, curved sidewalls 24, 26 allow the insulation brick 10 to conform to, and be arrayed about the vessel in close relationship to the sidewall of the vessel.

The insulation brick 10 may be formed from a variety of different materials depending on the vessel it is to be used with and the material properties of the industrial process. For example, the brick 10 may be made from a composite having mostly alumina, for example 55-75%, and containing silica and other impurities such as $Fe_2O_3$ and $TiO_2$. Also, a magnesia chrome brick may be used containing magnesia, $Cr_2O_3$, $Fe_2O_3$, CaO, and silica, for example 55-65% magnesia, 18-24% $Cr_2O_3$, 3-6%, $Fe_2O_3$, 0.8-1.2% CaO, and 0.5-1% silica. Or a high magnesia brick 10 may be used containing at least 95% magnesia.

As discussed in further detail below, the convex portion 18 of the insulation brick 10 is designed to mate with the concave portion 22 of a similar adjacent insulation brick. While this exemplary design is highlighted in this application, other mating arrangements such as a variety of male/female arrangements may be used with the insulation bricks 10 without departing from the spirit of the invention.

As best shown in FIGS. 1 and 2, the outer sidewall 24 has a set of corrugations 30. The quantity of the corrugations 30 will depend upon the length of the insulation brick 10. In an exemplary embodiment, the insulation brick 10 will have between four and five corrugations 30. The corrugations 30 may be a variety of shapes including curved or arcuate shapes such as cylindrical, spherical, or parabolic shapes, as well as channels, grooves, squares, or rectangular corrugations. In an exemplary embodiment the corrugations 30 are half cylinders. The corrugations 30 run the width of the insulation brick and, depending on the vessel to be lined and the desired thermal properties, may be different sizes. This may result in the corrugations 30 being in direct contact with each other or having intermediate planar portions 32. Additionally, the depth of the corrugations 30 may vary. For example, a corrugation having a 1.25 inch diameter may have a depth of 0.75 inches, or a corrugation having a 0.75 inch diameter may have depth of 0.5 inches.

Figure 3:
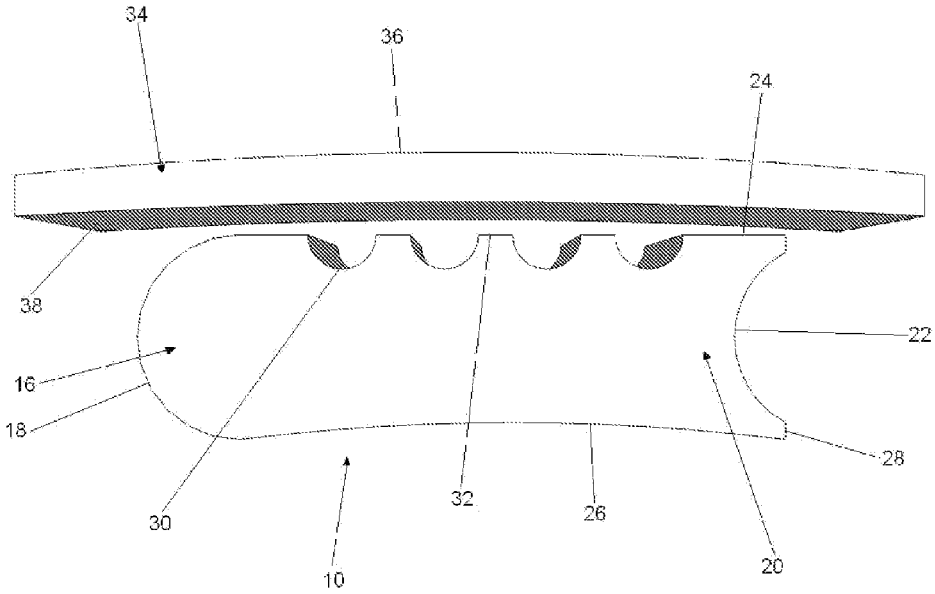
FIG. 3 is a perspective view an exemplary insulation brick and a sectional view of a vessel shell.

As best shown in FIG. 3, the insulation bricks 10 are used to line a vessel having a shell 34. The shell 34 comprises an outer wall 36 and an inner wall 38. The outer sidewall 24 of the insulation brick 10 is placed adjacent the inner wall 38 of the shell 34. As discussed above, the inner sidewall 26 preferably has a concave radius of curvature while the outer sidewall 24 has a convex radius of curvature. The curvature of the sidewalls 24, 26 allows the insulation bricks 10 to conform to a curved shell 34, though it is possible that only the outer sidewall 24 may need to be curved. Additionally, the curvature of the inner sidewall allows the lined vessel to maintain a maximum amount of holding space. The radius of curvature of the sidewalls 24, 26 may vary depending on the curvature of the shell 34. However, certain aspects of the invention, as discussed in further detail below, will allow the same shape of insulation brick 10 to be used in connection with a variety of shell configurations.

The corrugations 30 provide air pockets between the brick 10 and the shell 34 which increase the thermal insulation provided by the brick 10. As discussed above, the size and shape of these corrugations may be optimized to provide an ideal or required amount of thermal insulation. The increased thermal insulation provided by the corrugations 30 allows for less material to be used, such as in forming a thinner brick 10 than typical. In an exemplary embodiment where the brick 10 is utilized in a steel ladle, the thickness of the brick can be approximately 3 inches. Additionally, the corrugations 30 can eliminate the need to provide additional temporary insulation, such as insulation fiber, that may be commonly applied to the outer sidewall 24.

The number of corrugations 30 may be optimized to maintain a high level of insulation while maintaining good compression stress against flexing of the shell 34 during use. Adequate compression strength is important to prevent cracks from developing during such flexing. This is especially important when the insulation brick 10 is to be used with shells 34 having oval or obround configurations. These shapes are especially prone to flexing and difficult to operate with ceramic insulation boards for this reason. As mentioned above, four to five corrugations 30 result in greatly improved thermal efficiency while maintaining good compression stress against shell flexing. This, however, may vary depending on the length of the brick 10 and the size of the corrugations 30. For example, in a brick 10 that is 9 inches in length, five corrugations having a diameter of 0.75 inches may be used, or four corrugations having a diameter of 1.25 inches may be used. In an exemplary embodiment, different configurations of brick 10 may be used in the same lining to provide optimal performance at different points of the shell 34. Additionally, the planar portions 32 between the corrugations 30 will provide added strength to the insulation brick 10.

Figure 4:
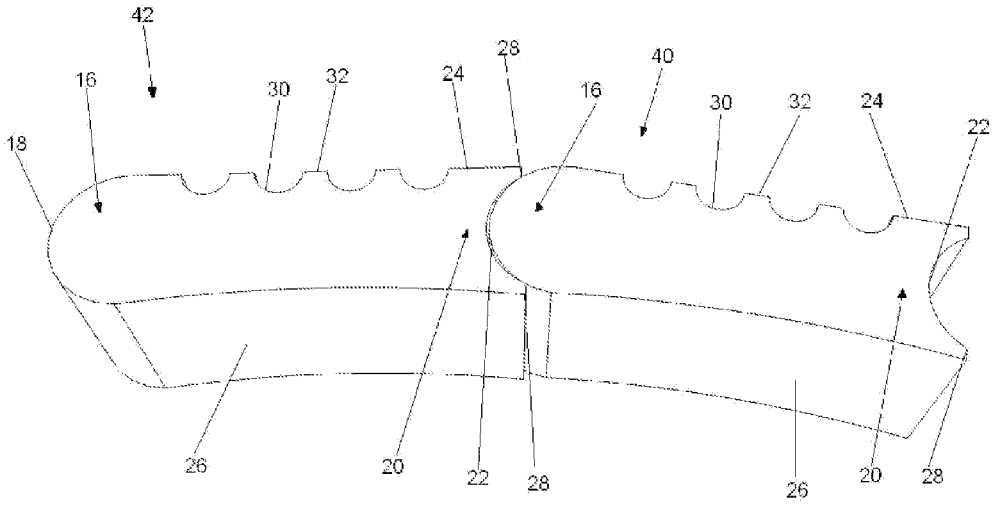
FIG. 4 is a perspective view of a mated pair of exemplary insulation bricks.

To line a vessel, a series of insulation bricks 10 are placed together to encircle the ladle and further are arrayed in a series of layers vertically along the ladle. As best shown in FIG. 4, a male portion of a first insulation brick 40 mates with the female portion of a second insulation brick 42, connecting the two together. In an exemplary embodiment, the male portion is convex portion 18 of the first end 16 of the first insulation brick 40 and the female portion is the concave portion 22 of the second insulation brick 42. By continuing this interconnection sequence, the insulation bricks can line a variety of different shapes and sized vessels. Because of the curved design of the insulation bricks ends 16, 20, the position of the bricks 40, 42 may varied. The angle of the bricks 40, 42 with respect to each other may be adjusted while maintaining a tight interface between the ends 16, 20. The angle of the bricks 40, 42 along with the curvature of the sidewalls 24, 26 enables the bricks 40, 42 to create an efficient lining in vessels having a variety of shapes and sizes. This versatility provides an advantage over prior insulation means which had to be made or formed specifically for a certain vessel or container. Additionally the fit of the convex portion 18 and the concave portion 22, can, in certain situations, eliminate the need to mortar between separate bricks 10, as is typical with other insulation methods.

Figure 5:
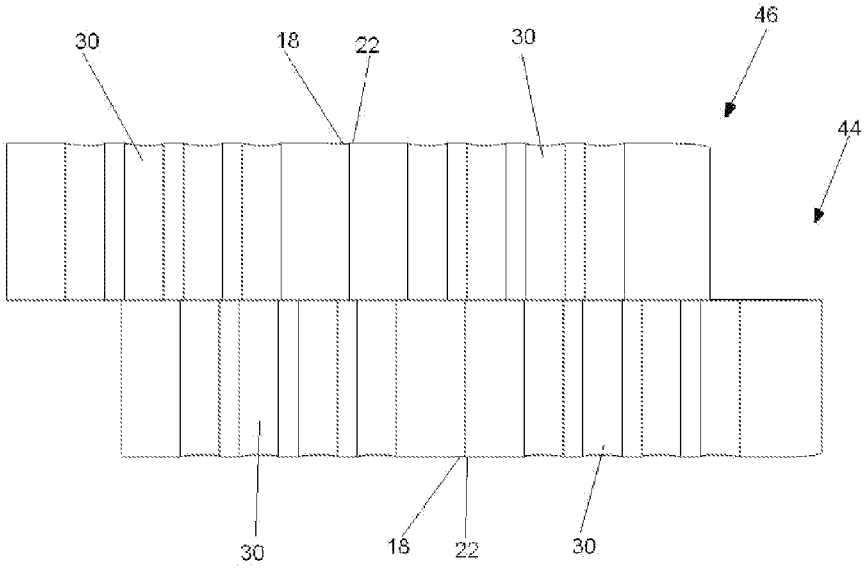
FIG. 5 is a plane view of a plurality of insulation bricks arranged in accordance with an exemplary embodiment of the invention.
Figure 6:
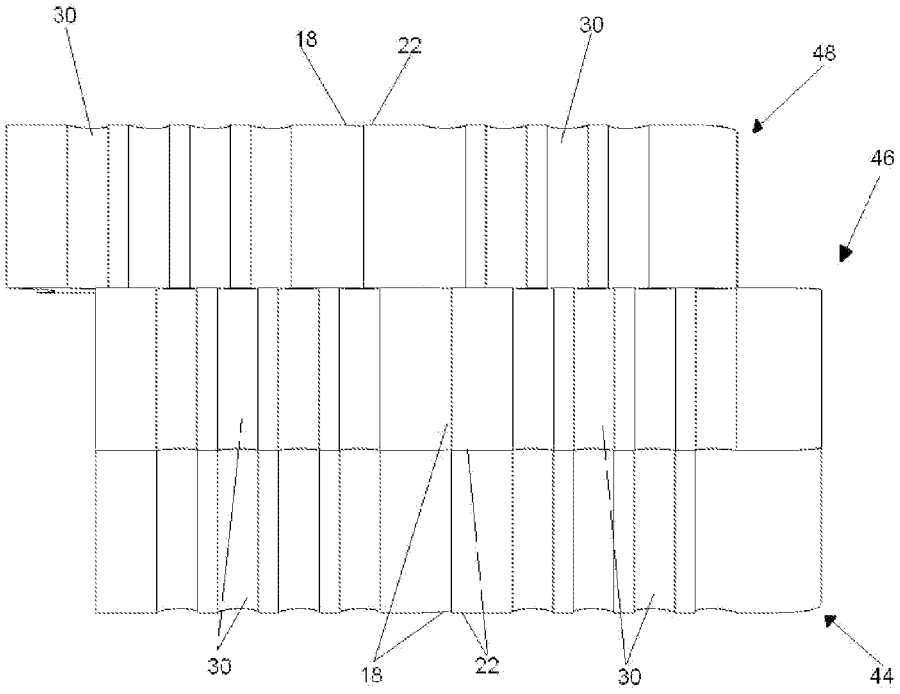
FIG. 6 is a plane view of a plurality of insulation bricks arranged in accordance with an exemplary embodiment of the invention.

As best shown in FIGS. 5 and 6, the bricks 10 can be aligned in a variety of different ways depending on the insulation requirements for the holding vessel. Because the corrugations 30 do not extend along the entire length of the brick 10, the thermal insulation advantages will also not be achieved along the entire length of the brick. In certain cases, in may be advantageous to evenly distribute the corrugations 30 along different layers. As best shown in FIG. 5, a first layer of brick 44 is offset from the second layer 46. This allows the corrugations 30 of the second layer of bricks 46 to be over the mating concave convex portions 18, 22 of the first layer of bricks 44. Additional layers of brick, if needed, may be then arranged so that they are in the same position as the first layer 44, or further offset in the direction of the second layer 46. The amount of the offset may be equal to the offset between the first layer 44 and the second layer 46, or it may vary.

As best shown in FIG. 6, the first layer of brick 44 may be aligned with the second layer of brick 46, so that a continuous channel is formed by the corrugations 30. A third layer 48, if necessary, may then either be aligned with the first and second layers 44, 46, or, as shown in FIG. 6, may be offset. Additionally, the bricks 10 may be placed at random, though providing organization to the bricks allows for great control of the heat transfer to a vessel's shell.

Figure 7:
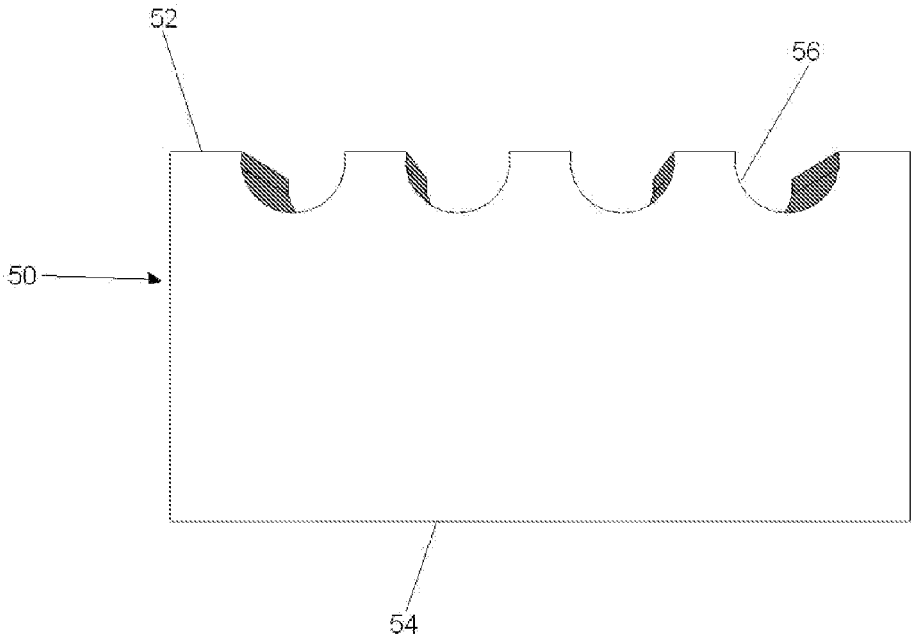
FIG. 7 is a plane view of an exemplary insulation brick.
Figure 8:
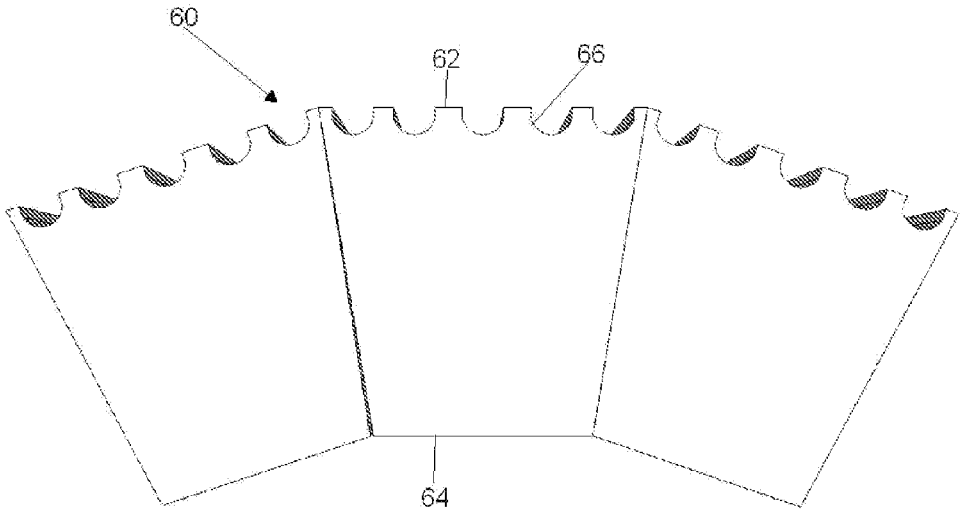
FIG. 8 is a plane view of an array of exemplary insulation bricks.
Figure 9:
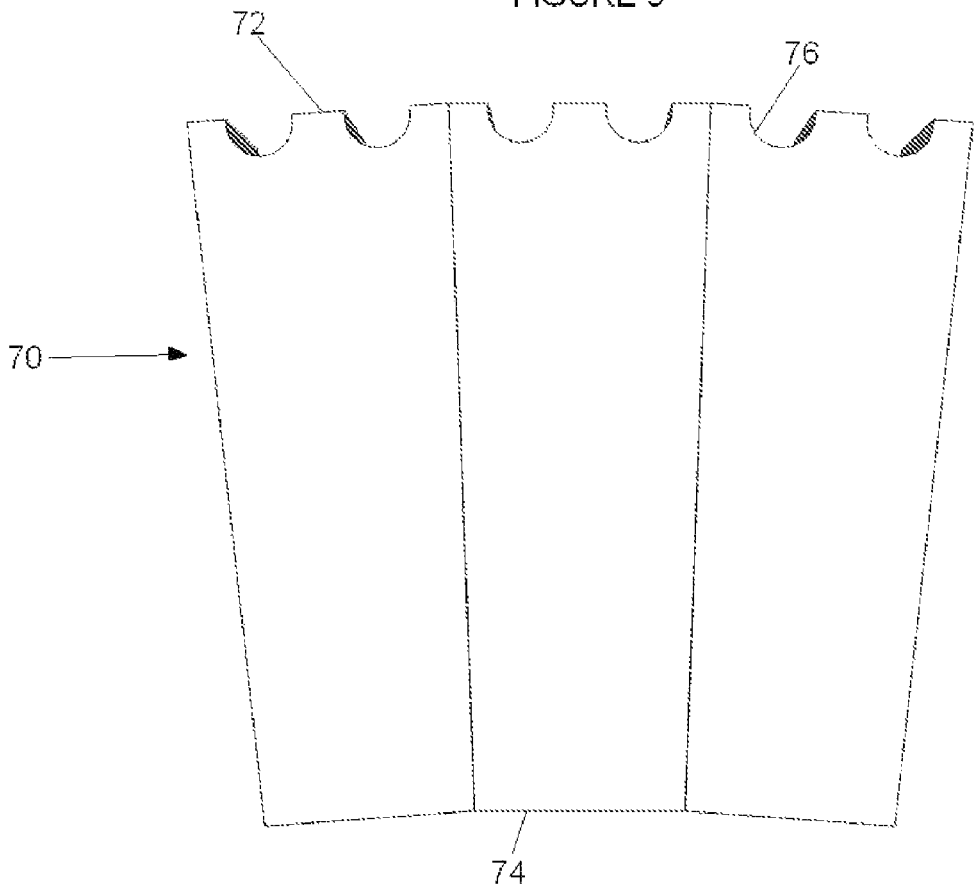
FIG. 9 is a plane view of an array of exemplary insulation bricks.

As best shown in FIGS. 7-9, a variety of different types of insulation bricks can be used in conjunction with this aspect of the invention. FIG. 7 shows a flat rectangular brick 50 having an outer sidewall 52 and an inner sidewall 54. The outer sidewall 52 has a set of corrugations 56. Rectangular brick 50 is best used for non-curved shaped vessels.

FIG. 8 shows an array of key shaped bricks 60 having an outer sidewall 62 and an inner sidewall 64. The outer sidewall has a set of corrugations 66. The outer sidewall 62 is longer than the inner sidewall 64, so that the brick has angled sides and can be placed together in the array as shown. This will enable the key shaped brick 60 to be used with various shapes of vessels such as those that may be curved or have a polygonal configuration.

FIG. 9 shows an array of narrow rectangular shaped bricks 70 having an outer sidewall 72 and an inner sidewall 74. The outer sidewall has a set of corrugations 76. As with the key shaped brick 60, the narrow rectangular bricks can have an outer sidewall 72 with a length greater than the inner sidewall 74 to enable the bricks 70 to be placed in an angled array.

The foregoing description of the exemplary embodiments of the present invention has been presented for the purpose of illustration. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. Moreover, features or components of one embodiment may be provided in another embodiment. Thus, the present invention is intended to cover all such modification and variations.

What is claimed:

1. A vessel for holding a high temperature material comprising;

a steel ladle having a shell with an outer wall and an inner wall;

a first layer of insulation bricks having an upper surface, a lower surface, a first end, a second end, an inner sidewall, and an outer sidewall having a set of corrugations; and a second layer of insulation bricks having an upper surface, a lower surface, a first end, a second end, an inner sidewall, and an outer sidewall having a set of corrugations, wherein the outer sidewall of said insulation bricks are adjacent the inner wall of the shell and the lower surface of said second layer of insulation bricks is in contact with the upper surface of said first layer of insulation bricks.

2. A vessel for holding a high temperature material according to claim 1, wherein the first end of said insulation bricks are designed to mate with the second end of an adjacent insulation brick.

3. A vessel for holding a high temperature material according to claim 1, wherein the corrugations of said first layer of insulation bricks are offset from the corrugations of said second layer of insulation brick.

4. A vessel for holding a high temperature material according to claim 1, wherein the corrugations of said first layer of insulation bricks are aligned with corrugations of said second layer of insulation brick.

5. A vessel for holding a high temperature material according to claim 1, wherein the insulation bricks have a flat rectangular shape.

6. A vessel for holding a high temperature material according to claim 1, wherein each insulation brick is a key shaped brick.

7. A vessel for holding a high temperature material according to claim 1, wherein the insulation bricks have a narrow rectangular shape where the first and second ends have a length greater than the outer sidewall and the inner sidewall.

8. A vessel for holding a high temperature material according to claim 7, wherein the length of the outer sidewall is greater than the length of the inner sidewall.

9. A vessel for holding a high temperature material comprising;

a steel ladle having a shell with an outer wall and an inner wall;

a first layer of insulation bricks having an upper surface, a lower surface, a first end having a convex portion, a second end having a concave portion, an inner sidewall, and an outer sidewall having a set of corrugations; and a second layer of insulation bricks having an upper surface, a lower surface, a first end having a convex portion, a second end having a concave portion, an inner sidewall, and an outer sidewall having a set of corrugations, wherein the outer sidewall of said insulation bricks are adjacent the inner wall of the shell and the lower surface of said second layer of insulation bricks is juxtaposed to the upper surface of said first layer of insulation bricks.

10. A vessel for holding a high temperature material according to claim 9, wherein the convex portion of the first end of said insulation bricks are designed to mate with the concave portion of the second end of an adjacent insulation brick.

11. A vessel for holding a high temperature material according to claim 10, wherein the corrugations of said first layer of insulation bricks are offset from the corrugations of said second layer of insulation brick.

12. A vessel for holding a high temperature material according to claim 11, wherein the corrugations of said second layer of insulation bricks are directly over the mated ends of the insulation bricks in said first layer.

13. A vessel for holding a high temperature material according to claim 10, wherein the corrugations of said first layer of insulation bricks are aligned with corrugations of said second layer of insulation brick.

* * * * *